United States Patent [19]

Madru, Sr.

[11] Patent Number: 4,996,737

[45] Date of Patent: Mar. 5, 1991

[54] VACUUM CLEANER POWER NOZZLE

[75] Inventor: Clifford A. Madru, Sr., Springfield, Mass.

[73] Assignee: Bryton Vacuum Company, Inc., Chicopee, Mass.

[21] Appl. No.: 521,901

[22] Filed: May 11, 1990

Related U.S. Application Data

[63] Continuation-in-part of Ser. No. 191,111, May 6, 1988, abandoned.

[51] Int. Cl.[5] ..... A47L 5/36

[52] U.S. Cl. ..... 15/366; 15/328; 15/377; 15/422.2

[58] Field of Search ..... 15/366, 377, 328, 412, 15/422.2

[56] References Cited

U.S. PATENT DOCUMENTS

| | | | |
|---|---|---|---|
| 1,914,834 | 6/1933 | Otto | 15/377 X |
| 2,218,035 | 10/1940 | Benson | 15/422.2 X |
| 3,184,775 | 5/1965 | Downey et al. | 15/412 X |
| 3,212,119 | 10/1965 | Humphrey | 15/391 |
| 3,310,828 | 3/1967 | Clark | 15/328 |
| 3,618,158 | 11/1971 | Worwag | 15/391 X |
| 3,634,905 | 1/1972 | Boyd | 15/413 X |
| 3,774,261 | 11/1973 | Colt | 15/321 |
| 4,137,599 | 2/1979 | Steyer | 15/422.2 |
| 4,199,839 | 4/1980 | Martinec | 15/354 |
| 4,446,594 | 5/1984 | Watanabe et al. | 15/354 X |
| 4,463,473 | 8/1984 | Nakada et al. | 15/413 X |

*Primary Examiner*—Chris K. Moore

*Attorney, Agent, or Firm*—Ross, Ross & Flavin

[57] ABSTRACT

An air booster power nozzle for use in combination with a vacuum cleaner having a motor/fan unit for creating a vacuum, the power nozzle including an enclosed base having a suction inlet for air and an air outlet spaced from the suction inlet, a power source and a motor energized by the power source, a suction-creating fan rotatably supported by the motor and sited relative to the enclosed base adjacent the air outlet; the motor/fan units of the vacuum cleaner and of the power nozzle operating in tandem for creating an extremely high suction and vacuum at the power nozzle to forcefully remove debris from the surface being cleaned and to preclude plugging of the power nozzle or the vacuum cleaner.

6 Claims, 5 Drawing Sheets

VACUUM CLEANER POWER NOZZLE

CROSS REFERENCE TO RELATED APPLICATIONS

This is a continuation-in-part of my co-pending application Ser. No. 07/191,111, filed May 6, 1988, and now abandoned.

BACKGROUND OF THE INVENTION

1. Field of the Invention

The invention relates to and is limited to a power nozzle of a vacuum cleaner system, such as a canister type vacuum using a power nozzle or a central vacuum system using a power nozzle.

2. Description of Related Art

The nozzles produced in today's market reflect such things as straight suction tools, which clean a carpet by means of suction created at the canister or the central vacuum. There is also available an air-driven power nozzle type wherein the suction created at the canister or central vacuum turns a squirrel cage type fan, which sequentially turns a brush roller, without the use of electricity. This is one step above a straight suction tool in cleaning ability. The next step is an electric power nozzle which has a small electric motor which turns a brush roller, the suction created at the canister or the central vacuum being what actually picks the dirt up from the surface being cleaned.

In prior art devices, no means is provided for movement where the wand attaches to the nozzle. Therefore, the user cannot manipulate the nozzle in a back and forth motion, thus giving an awkward feel to any vacuuming procedure.

SUMMARY OF THE INVENTION

In the invention hereof, a fourth dimension of cleaning ability has actually been added in an electric nozzle, wherefor the description "Electric Air Booster Power Nozzle." When a canister or a central vacuum is used to clean carpeting, the suction of the cleaner is cut off by the back and forth motion of the unit on the carpet, and the dirt passing from the power nozzle through the tubing and flexible hose to the canister causes the water lift or suction of the vacuum to drop significantly.

What the instant invention does is allow the canister or central vacuum actually to run more smoothly because the vacuum source is adjacent the carpet allowing the suction of the canister to stay constant. This problem has plagued the canister and central vacuum market for years, forcing manufacturers of these products to create larger motors and fans in the canister section of the cleaners in order to compensate for the inability of the unit to clean a carpet successfully. With the invention hereof, it is no longer necessary for the industry to create a monstrous, high horse power machine to clean satisfactorily.

The invention functions as an air booster power nozzle which must be connected to another vacuum source in order to be properly used as intended. If the nozzle were to be used as an upright type vacuum, it would then have to have another vacuum source, such as a canister or central vacuum. The upright section would have to have another motor fan source to create vacuum, and be joined together with the nozzle, so that the nozzle is always used as a power nozzle.

The invention relates to a fan chamber as a first stage suction device located only six inches or so from the actual surface being cleaned. It teaches a totally clear passage, with an unobstructed means for allowing dirt and debris lifted from the surface to transfer from the brush roller housing through the power nozzle and through the fan itself, allowing the suction of the cleaner to transfer the dirt and debris back, to the support or backup portion of the vacuum system.

A fan in the power nozzle portion is used in tandem with another vacuum source, be it a canister or a central vacuum system, so as to provide an exceptionally high volume of air flow at the nozzle for enhancing the cleaning ability of the system.

Although other power nozzles have existed which have also created a vacuum, non have used the means of driving the fan without obstruction of either the belt in the same housing as the fan or allowing the channel extending through the housing to the brush roller section to be small enough actually to create a water lift type vacuum.

The means hereof is created by two smooth surfaces, creating a tunnel from the front portion of the nozzle where the brush roller is attached to the fan chamber where a high degree of air velocity creates an extremely high water lift type vacuum at the brush roller itself.

Further, the nozzle portion which attaches to the wand is movable in an up and down motion, for ease of use by the user. Also, a pivoting portion around the fan blade allows twisting motions into myriad angles, all so that whatever the angle the nozzle is positioned in, the suction is never obstructed or decreased.

The power nozzle can never be used by itself as a vacuum within itself. It is restricted to a boosting of the cleaning capability of another vacuum source, as in a canister or central vacuum system. It is, in fact, an accessory item to the vacuum industry for use on such products.

With the air booster power nozzle hereof, the nozzle is always used strictly as a power nozzle. It is never converted to create another product. A nozzle has not been created to convert to an upright or any other type vacuum. An accessory item has been created for the industry that specifically relates to the power nozzle, more specifically, an electric power nozzle, with the addition of a highly sophisticated motor/fan design and extremely unique swivel section.

DESCRIPTION OF THE PREFERRED EMBODIMENT

Figure 1:
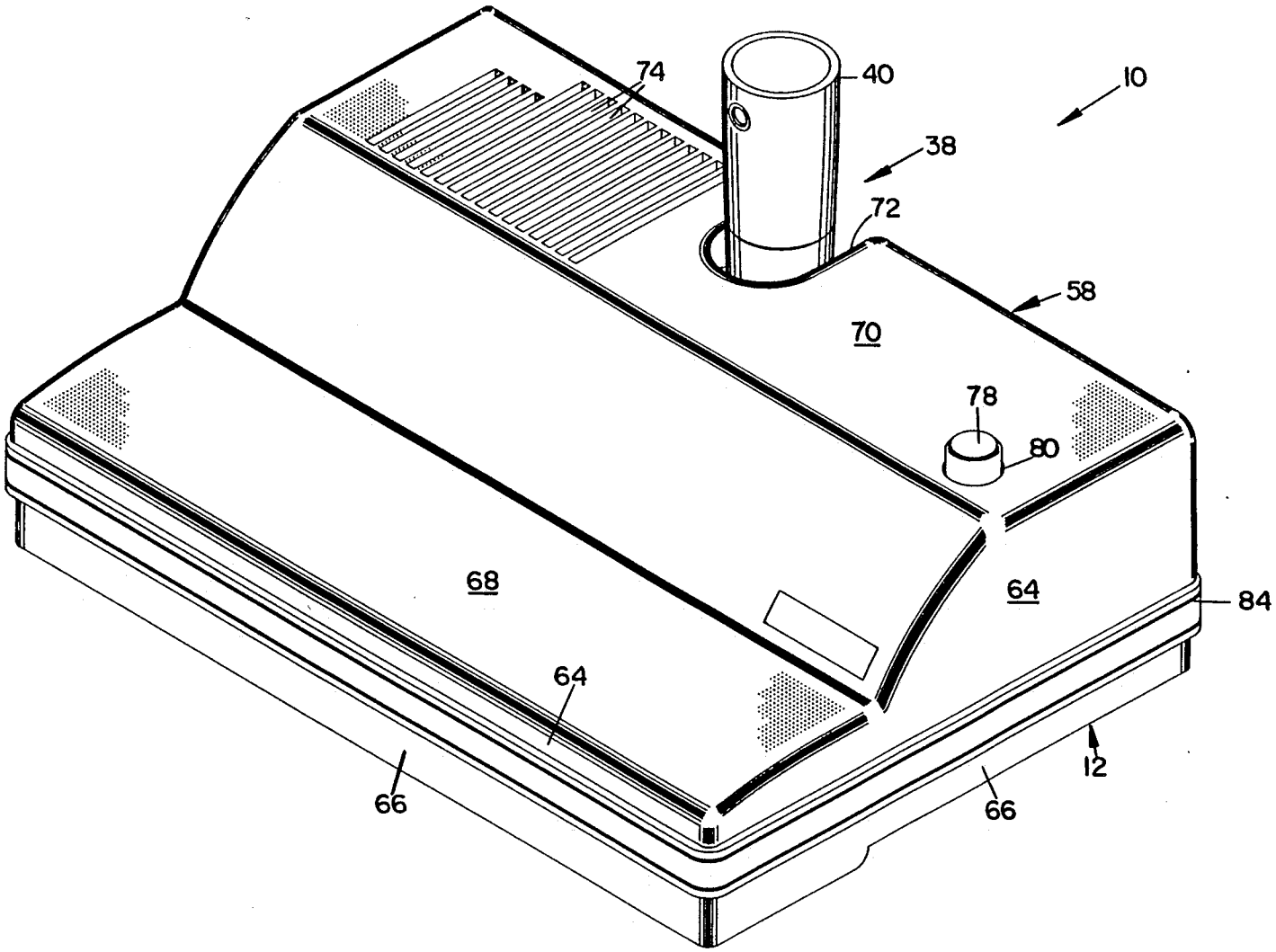
FIG. 1 is a perspective view of the Power Nozzle of the invention.
Figure 2:
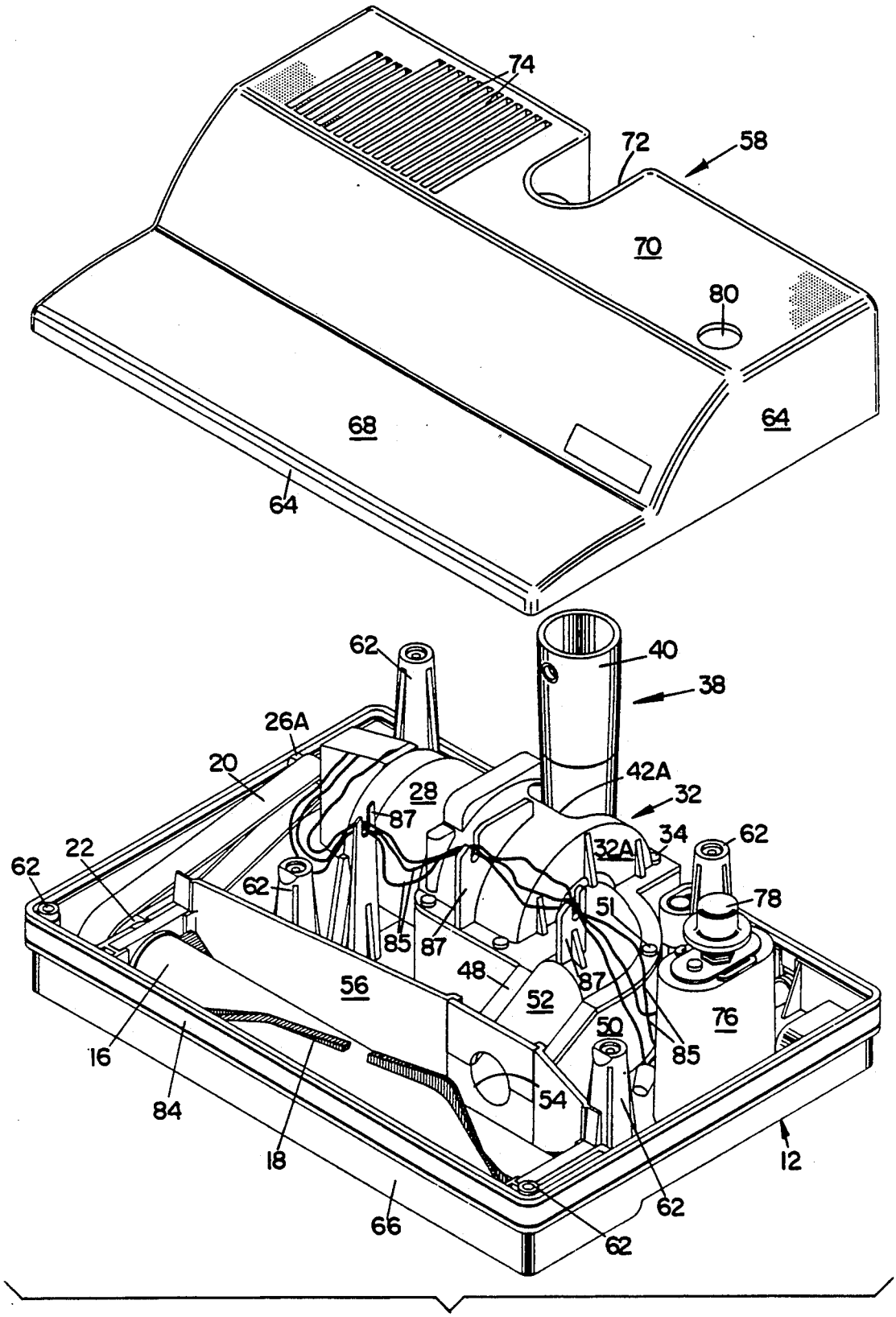
FIG. 2 is an exploded perspective view of the Power Nozzle of the invention with the cover raised to expose the inner components.
Figure 3:
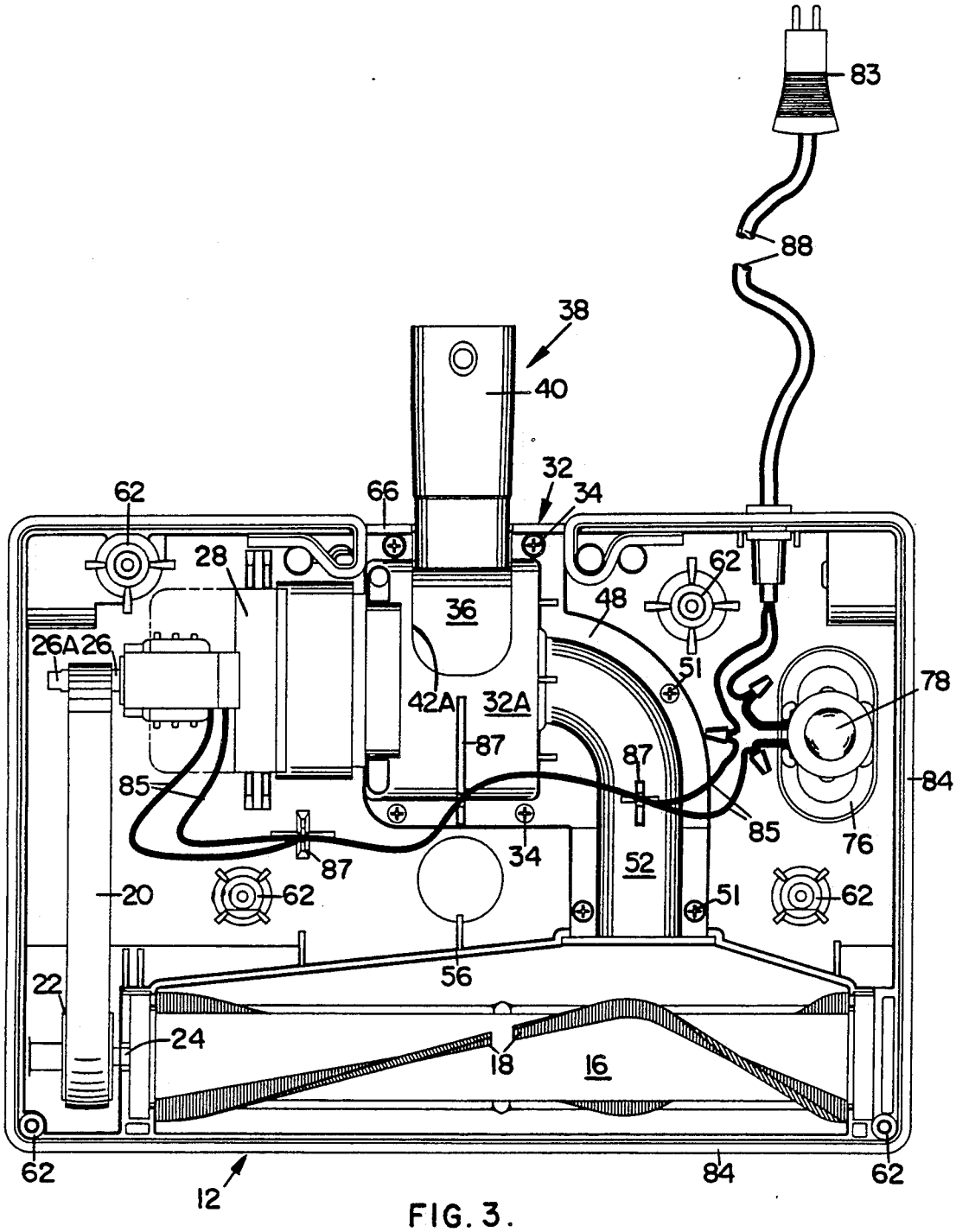
FIG. 3 is a top plan view of the Power Nozzle of the invention with the cover removed.

The power nozzle of the invention is generally indicated by 10 and is readily adaptable for use with canister-type or central-type vacuum cleaners, not shown.

In either instance, the power nozzle serves to augment, or "boost" the suction and cleaning power of the unit to which it is coupled.

Power nozzle 10 includes a generally rectangular base 12 having a pair of spaced wheels 14 journalled relative thereto adjacent its rearward edge for rolling engagement with the floor or other surface to be cleaned, and a transversely-extending roller 16 rotatably mounted relative thereto adjacent its forward edge and having spaced rows of bristles 18 extending outwardly therefrom through a transversely-extending suction inlet opening 19 in base 12. Bristles 18 are adapted to contact the floor or rug or other surface to be cleaned.

Roller 16 is rotated by a belt 20 entrained around a pulley 22 fixed to the roller shaft 24 and around one end 26A of a drive shaft 26 extending outwardly from one side of a motor 28 spaced from the roller and fixed to base 12.

An opposite end 26B of drive shaft 26 extends outwardly from the opposite side of motor 28 and has a fan 30 fixed to its outer free end and disposed within a partly enclosed fan housing 32.

Figure 5:
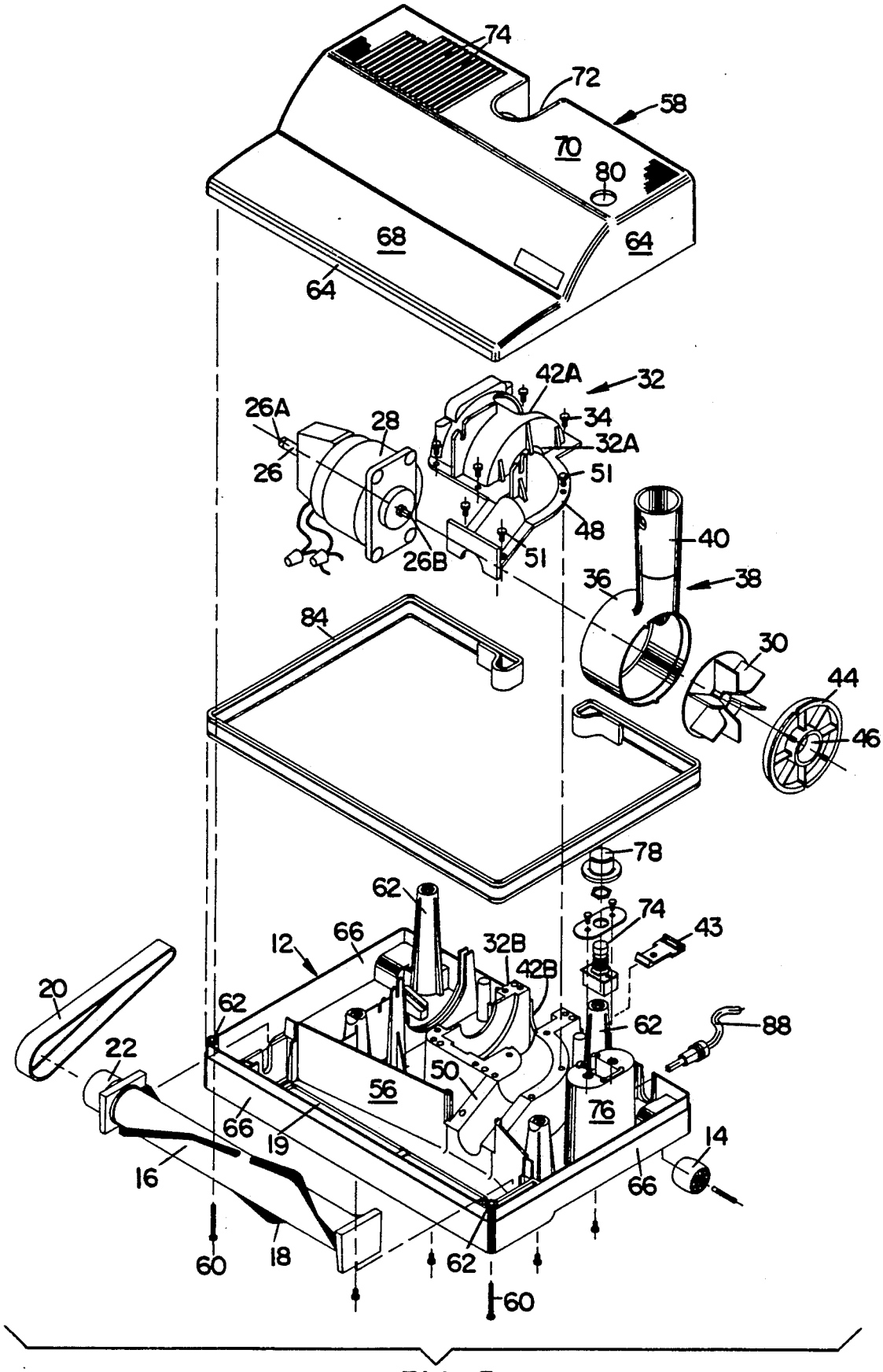
FIG. 5 is an exploded perspective view of the Power Nozzle of the invention with the component parts disassembled.

As best seen in FIG. 5, fan housing 32 comprises an upper semi-circular half-part 32A secured as by screws 34 or the like to a lower semi-circular half-part 32B formed as an integral component of base 12.

In addition to accommodating fan 30, fan housing 32 enclosed, in circumscribing manner, an annular ring-like lower end 36 of a swivellable casing 38 which has an integral tubular extension 40 extending vertically upwardly therefrom through provided semi-circular openings 42A and 42B in the rear faces of housing upper half-part 32A and housing lower half part 32B respectively.

Tubular extension 40 functions as the air outlet conduit for power nozzle 10, as will appear.

Ring-like lower end 36 of swivellable casing 38 may be swiveled relative to fan housing 32 upon forward and back movement, of tubular extension 40 during use of the power nozzle, to facilitate cleaning, as will appear.

A swivel lock 43, (see FIG. 5), is slidably related to base 12 for selectively engaging ring-like lower end 36 of swivellable casing 38 for locking the swivel nozzle and tubular extension in an upright or storage position.

A swivel spacer 44 is disposed in an open side of swivel nozzle lower end 36 and has a central opening 346 therethrough which communicates with the hollow interior of lower end 36.

Upper half-part 32A of fan housing 32 has an integral extension 48 formed at one side thereof and extending forwardly therefrom so as to overlie a complemental extension 50 formed integrally with and extending forwardly from one side of lower half-part 32B.

Extension 48 is fixed to extension 50 by screws 51 or the like.

Extensions 48 and 50, when mated, are so configured as to form between them tubular channel 52 which communicates at one end with the interior of fan housing 32 and opening 46 of swivel spacer 44 and at its opposite end at 54 with suction inlet opening 19 of base 12. Suction inlet opening 19 is framed at its rearward edge by an upright wall 56 which has opening 54 extending through a portion thereof.

A cover 58 is engageable with base 12 and is secured to the base by a plurality of screws 60 which pass through bosses 62 in the base and are threadedly engaged in aligned openings, not shown, in the cover.

Peripheral walls 64 of cover 58 are complemental with peripheral walls 66 of base 12 to provide a precise fit when the two components are mated.

A horizontally-disposed, transversely-extending forward portion 68 of an upper wall 70 of cover 58 overlies suction inlet opening 19 in base 12 and sealingly engages with the upper edge of upright wall 56 of the base to form a sealed compartment surrounding brush roller 16 and opening 19.

Cover 58 is appropriately relieved as at 72 to permit the free passage of tubular extension 40 of swivel nozzle 38 therethrough and to permit forward and rearward swiveling movement of tubular extension 40.

Grid-like openings 74 in upper wall 70 of cover 58 adjacent motor 28 permit circulation of cooling air around the motor.

A push-button on-off switch 74 is fixed to a boss pedestal 76 on base 12 and has a protective cover 78 which extends upwardly through a provided opening 80 in cover 58.

Pedestal 76 permits mounting of switch 74 on base 12 without the necessity of attaching any wiring to cover 58, permitting easy removal of the cover from the base.

Pedestal 76 supports the switch and protects it against damage regardless of how hard the switch may be engaged by the foot of an operator.

Switch 74 is disposed between motor 28 and an electric power cord 88 having a plug 83 for connecting the power nozzle to an external power source.

Wiring 85 connects between motor 28, switch 74 and power cord 88, and is channeled by the bifurcated upper ends of spaced supports 87 provided on base 12, allowing for clear passage of the wiring throughout so that it cannot be pinched between cover 58 and base 12 during assembly or disassembly of the unit.

A resilient bumper 84 is fixed to and disposed outwardly of the walls 66 of base 12 to provide a furniture guard.

Figure 4:
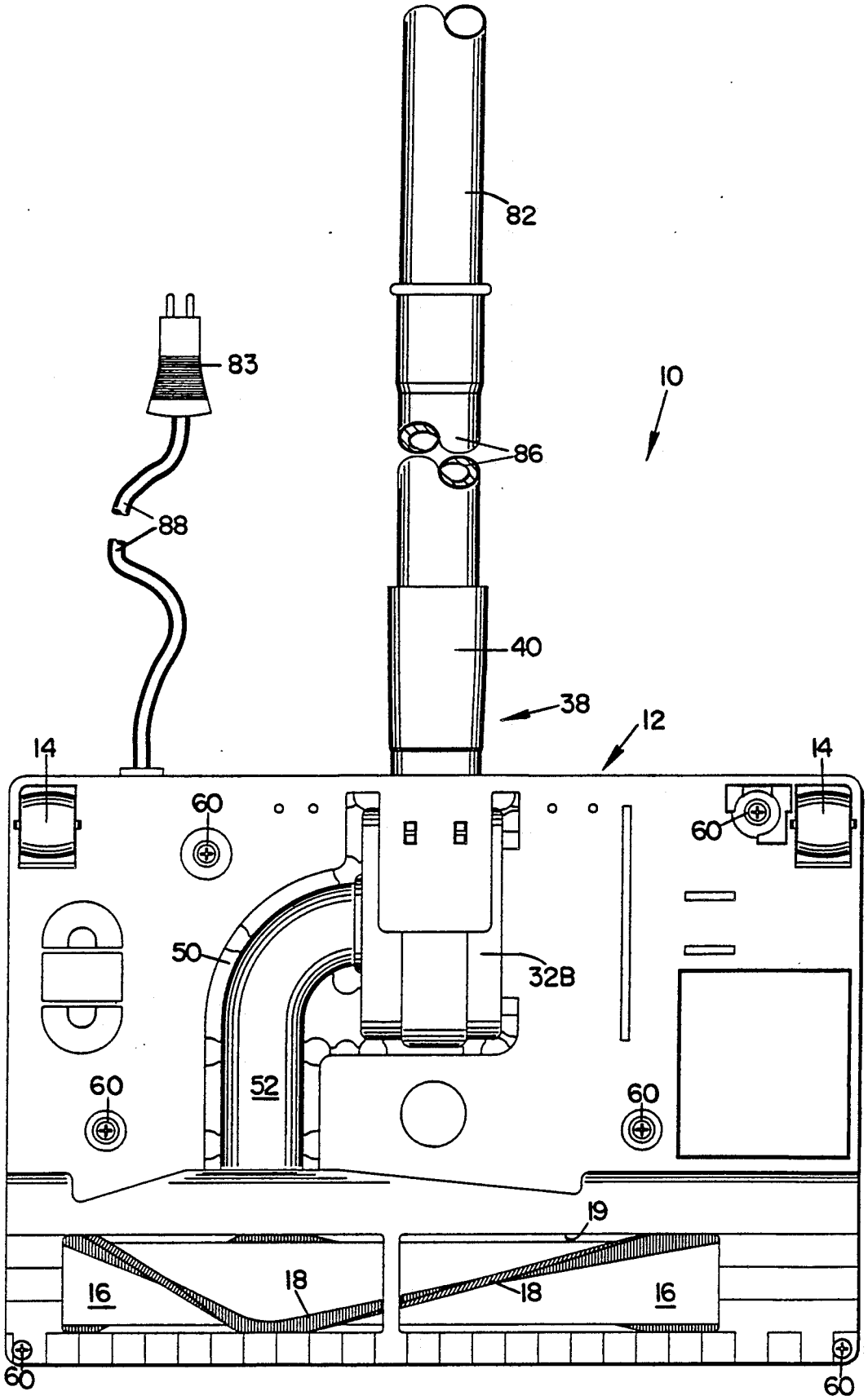
FIG. 4 is a bottom plan view of the Power Nozzle of the invention.

As shown in FIG. 4, a wand 86 is releasably connected at one end to extension 40 of swivellable casing 38 and at its opposite end to a hose 82 leading from a canister-type or central-type vacuum cleaner, not shown.

Fan housing 32 functions as a first stage suction device disposed only six inches or so from the actual surface to be cleaned.

Channel 52 provides a totally clear passage and an unobstructed means of allowing dirt and debris lifted from the surface to transfer from the brush roller compartment through the power nozzle and through the fan itself, allowing the suction of the cleaner to transfer the dirt and debris through air outlet swivellable casing 38 and wand 86 back to the support or backup portion of the vacuum system.

Herein, fan 30 is driven without obstruction by belt 20, the two compartments being disposed in separate compartments in base 12, along with a separate restricted channel 52 of small enough cross section to actually create a water lift type of vacuum.

Channel 52 is created by two mating smooth surfaces, which form a tunnel from the front portion of the power nozzle where brush roller 16 is attached, to the fan chamber 32 where a high degree of air velocity creates an extremely high water lift type vacuum at the brush roller itself.

Swivellable casing 38, which attaches to wand 86, is movable in an up and down motion, for ease of use. Also, ring portion 36 of swivellable casing 38 pivots around the fan 30 allowing a twisting into myriad angles so that whatever the angle swivellable casing 38 is positioned in, the suction is never obstructed or decreased.

Fan 30 in power nozzle 10 is used in tandem with another vacuum source, be it a canister or a central vacuum system, and provides an extremely high volume of air flow at the nozzle for enhancing the cleaning ability of the system.

I claim:

1. An air booster power nozzle for use in combination with a vacuum cleaner having a motor/fan unit for creating a vacuum, the power nozzle comprising:

an enclosed base having a suction inlet formed therein for air and passable over the surface to be cleaned and an air outlet formed therein spaced from the suction inlet, a power source and a motor and associated drive shaft energized by the power source, a suction-creating fan rotatably supported by and for coaxial rotation with the motor drive shaft and sited relative to the enclosed base adjacent the air outlet;

a rotatably-mounted power-driven surface-contacting beater brush journalled in the enclosed base adjacent the suction inlet for loosening dirt from the surface to be cleaned;

a drive train interconnecting the motor drive shaft and brush for driving the brush as an incident of rotation of the motor;

means providing a first portion of the path of flow for air defined by a brush housing encasing the brush adjacent the suction inlet and a fan housing encasing the fan adjacent the air outlet and a conduit interconnecting the brush and fan housings affording direct communication between the suction inlet and air outlet for the flow of sucked dirt loosened by the brush and induced through the conduit under the fan influence unobstructed by the motor and drive train;

a swivellable casing defining the air outlet connected to the enclosed base; and means providing a second portion of the path of flow of air connecting between the swivellable casing and the suction inlet of the vacuum cleaner;

whereby, the power nozzle, operating in tandem with the vacuum cleaner, creates an extremely high vacuum at the power nozzle suction inlet.

2. An air booster power nozzle according to claim 1, wherein the swivellable casing is swingably connected to the enclosed base.

3. An air booster power nozzle according to claim 1, wherein the suction-creating fan and swivellable casing are both encased by the fan housing.

4. An air booster power nozzle according to claim 1, wherein the suction-creating fan and swivellable casing are encased in a common housing in communication with the air outlet and wherein the conduit interconnecting between the brush and fan housings is formed by mating half-parts formed as integral extensions on the fan housing and base.

5. An air booster power nozzle according to claim 1, including a manually engageable on-off switch disposed between the power source and motor mounted on a pedestal in the base.

6. An air booster power nozzle according to claim 5, including wiring connecting between the switch, power source and motor, and spaced supports on the base for channeling the wiring.

* * * * *